US007063011B2

(12) United States Patent
Roos

(10) Patent No.: US 7,063,011 B2
(45) Date of Patent: Jun. 20, 2006

(54) HOT STAMPING CYLINDER

(75) Inventor: Robert Nikolaus Roos, Rorschacherberg (CH)

(73) Assignee: Gallus Ferd. Ruesch AG, St. Gallen (CH)

( * ) Notice: Subject to any disclaimer, the term of this patent is extended or adjusted under 35 U.S.C. 154(b) by 0 days.

(21) Appl. No.: 10/489,494

(22) PCT Filed: Mar. 12, 2004

(86) PCT No.: PCT/CH2001/000553

§ 371 (c)(1),
(2), (4) Date: Aug. 19, 2004

(87) PCT Pub. No.: WO03/022579

PCT Pub. Date: Mar. 20, 2003

(65) Prior Publication Data

US 2005/0005787 A1 Jan. 13, 2005

(30) Foreign Application Priority Data

Sep. 13, 2001 (EP) ..... 01122047

(51) Int. Cl.
*B31F 1/07* (2006.01)

(52) U.S. Cl. ..... 101/8; 101/25; 101/31

(58) Field of Classification Search ..... 101/25, 101/9, 8, 22, 23, 27, 21, 31
See application file for complete search history.

(56) References Cited

U.S. PATENT DOCUMENTS

| | | | | |
|---|---|---|---|---|
| 3,649,810 | A * | 3/1972 | Tsuboi et al. | 219/216 |
| 5,713,273 | A * | 2/1998 | Lai | 101/9 |
| 6,070,615 | A * | 6/2000 | Chen | 138/33 |

FOREIGN PATENT DOCUMENTS

| | | | |
|---|---|---|---|
| DE | 88 13 088 U | | 1/1988 |
| DE | 297 02 801 U | | 3/1997 |
| DE | 197 16 424 A | | 11/1998 |
| JP | 06341314 A | * | 12/1994 |
| JP | 08313168 A | * | 11/1996 |
| JP | 08319908 A | * | 12/1996 |
| SU | 1733734 A | * | 5/1992 |

* cited by examiner

*Primary Examiner*—Ren Yan
(74) *Attorney, Agent, or Firm*—Pearne & Gordon LLP

(57) ABSTRACT

The hot stamping cylinder (1) is provided with a heating system which consists of a heating foil (3) which is arranged on the inner wall of the cylinder (1), enabling extraordinarily quick heating and cooling times. In addition to actually heating the surface of the cylinder and the annular or sleeve-type stamping tools (10) placed thereon, the latter are clamped by thermal expansion in said adjusted position.

17 Claims, 2 Drawing Sheets

HOT STAMPING CYLINDER

BACKGROUND OF THE INVENTION

The present invention relates to a hot stamping cylinder of metal, with a heating system located in the cylinder hollow space. Until now, punching or stamping cylinders for hot stamping processes have been heated by oil in that the inner space of the cylinder has been filled with oil and coupled to an oil circuit with an external oil heating apparatus.

This method is cumbersome and the mobility inside of a printing machine is considerably limited. Additionally, the controlling of the temperature is very sluggish, high energy losses are encountered and problems regarding the disposal of waste oil are produced.

A different method for the heating of the cylinders is based on the application of an electrical heating cartridge in the center of the cylinder with an energy supply through slip rings.

The drawbacks of this solution are the short useful lifetime of the heating wires due to their high temperature stress, a sluggish regulating and long cooling times due to a high heat capacity.

SUMMARY OF THE INVENTION

Object of the present invention has been to design a heater for a hot stamping cylinder so that the known drawbacks no longer occur, an optimal heat distribution is possible and the entire matter can be arrived at with as simple as possible means.

This object has been met at a hot stamping cylinder of the kind mentioned above in accordance with the present Due to the invention it is possible to achieve, apart from the optimal and efficient heat distribution at the cylinder, a simple clamping of the tools in the desired position on the cylinder (expansion and contraction, resp. of the cylinder jacket larger than that of the ring or sleeve, resp. shaped tools). In order to achieve this, a cylinder of aluminum with an as thin as possible wall thickness with tools of brass is applied. By means of this the thermal expansion of the cylinder is utilized as clamping means for the tools.

Due to the heating foil which is pressed against the inner wall of the cylinder it is possible to design latter in such a manner that the heating output turns out to be higher in predetermined areas, e.g. at the end of the cylinder in order to compensate for the larger heat discharge through the cylinder bearings. This is achieved in that the distribution of the heating conductors on the heating foil is always selected to be so dense that a homogeneous heat distribution over the entire with of the working area is ensured.

A homogeneous pressing on force of the heating foil onto the inner wall of the cylinder is achieved advantageously by expansion brackets which at the same time allow a possibly necessary exchanging of the heating foil speedily and in a simple manner.

Also to be noted is that the thinner the wall of the cylinder is, the less its heat capacity is and accordingly the heating up and cooling down times, thus the capacity to react at a not constant heat discharge during operation is accordingly faster. The cooling time can be shortened additionally substantially by additional forced air cooling of the cylinder (cooling ventilator).

The surface temperature of the cylinder is controlled preferably to a desired temperature and held constant. A temperature sensor belongs to the controlling which is integrated in the heating foil, in the cylinder jacket or otherwise inside of the cylinder.

The subject of the invention allows a much simpler change of the process in the pressing part (stamping part), a substantially more homogeneous heat distribution on the stamping cylinder (also at the edge areas), a constant operating temperature due to a quicker controlling of the temperature, quick heating up and cooling down times and a high efficiency due to the local heat generation. Although the heating elements (heating foils) have a long useful life time they can be exchanged in a simple and quick manner. The invention allows additionally a simple mounting of the tools by the heat expansion occurring between the cylinder and tools (shrinking, clamping).

BRIEF DESCRIPTION OF THE DRAWINGS

In the following, the invention is explained somewhat more in detail based on an exemplarily embodiment illustrated in the drawing. There is shown in.

DETAILED DESCRIPTION OF THE INVENTION

Figure 1:
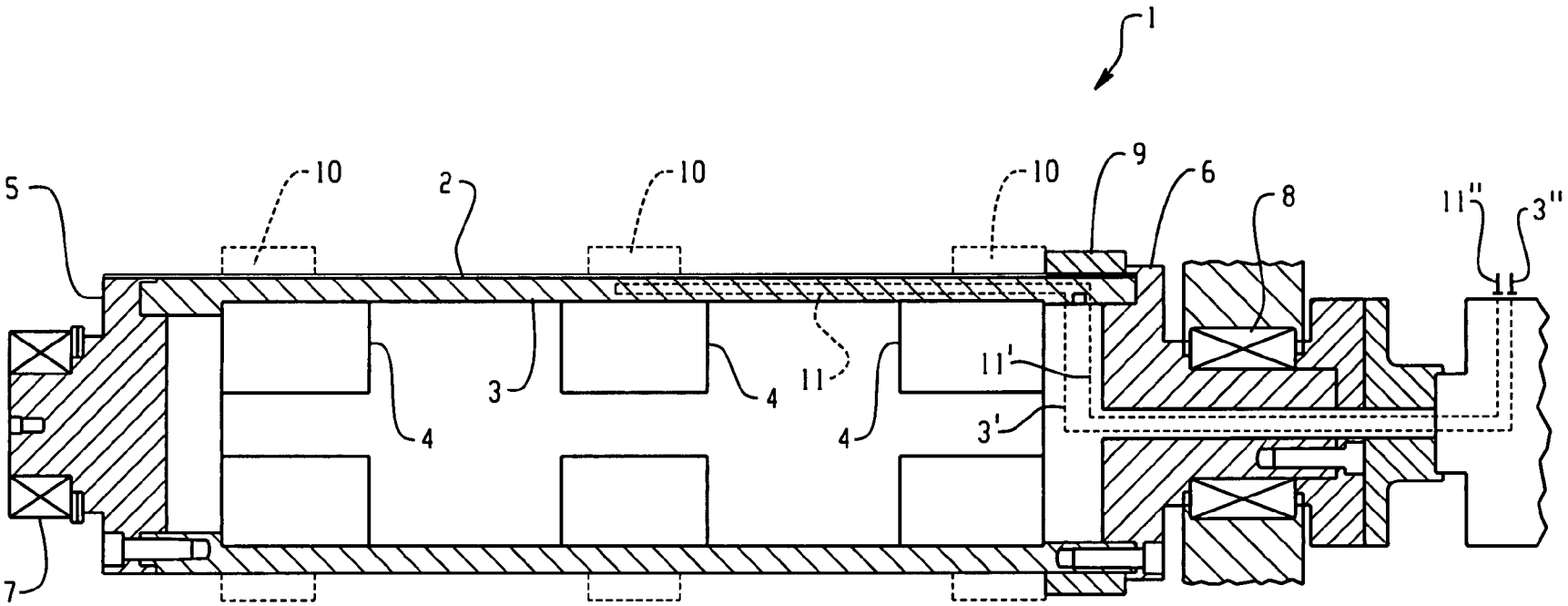
FIG. 1 a longitudinal section through a hot stamping cylinder in accordance with the invention, and FIG. 2 a cross section through a cylinder according to FIG. 1 (at an enlarged scale).

The hot stamping cylinder I illustrated in the drawing includes a cylinder jacket 2 of aluminum and a heating foil 3 pressed against the inner wall of the cylinder, whereby the pressing on is achieved by a plurality of resilient expansion clamps 4 (the clamps can be arranged at mutual distances or directly side by side).

The cylinder is supported in an as such known way through end flanges 5, 6 in bearings 7, 8 and is driven e.g. through a gear rim 9. Stamping tools 10 of brass are set onto the outer surface of the cylinder (they are arrested by thermal expansion of the cylinder jacket 2 in the set position).

A temperature sensor 11 is integrated in the cylinder wall. The electrical connections of the sensor 11 and of the heating foil 3, as well (energy supply) proceeds through conduits (identified schematically by 11' and 3', resp.) which are located in the rotating cylinder 1 and extend in a way known as such to collector rings 11" and 3", resp.

The heating foil 3, of a heat resistant material, includes a plurality of conduits performed in consideration of the local requirements (looks similar to a perforated sheet metal or an expanded metal foil, resp.). The geometrical design (variously dense distribution) proceeds in accordance with the order at the producer).

Figure 2:
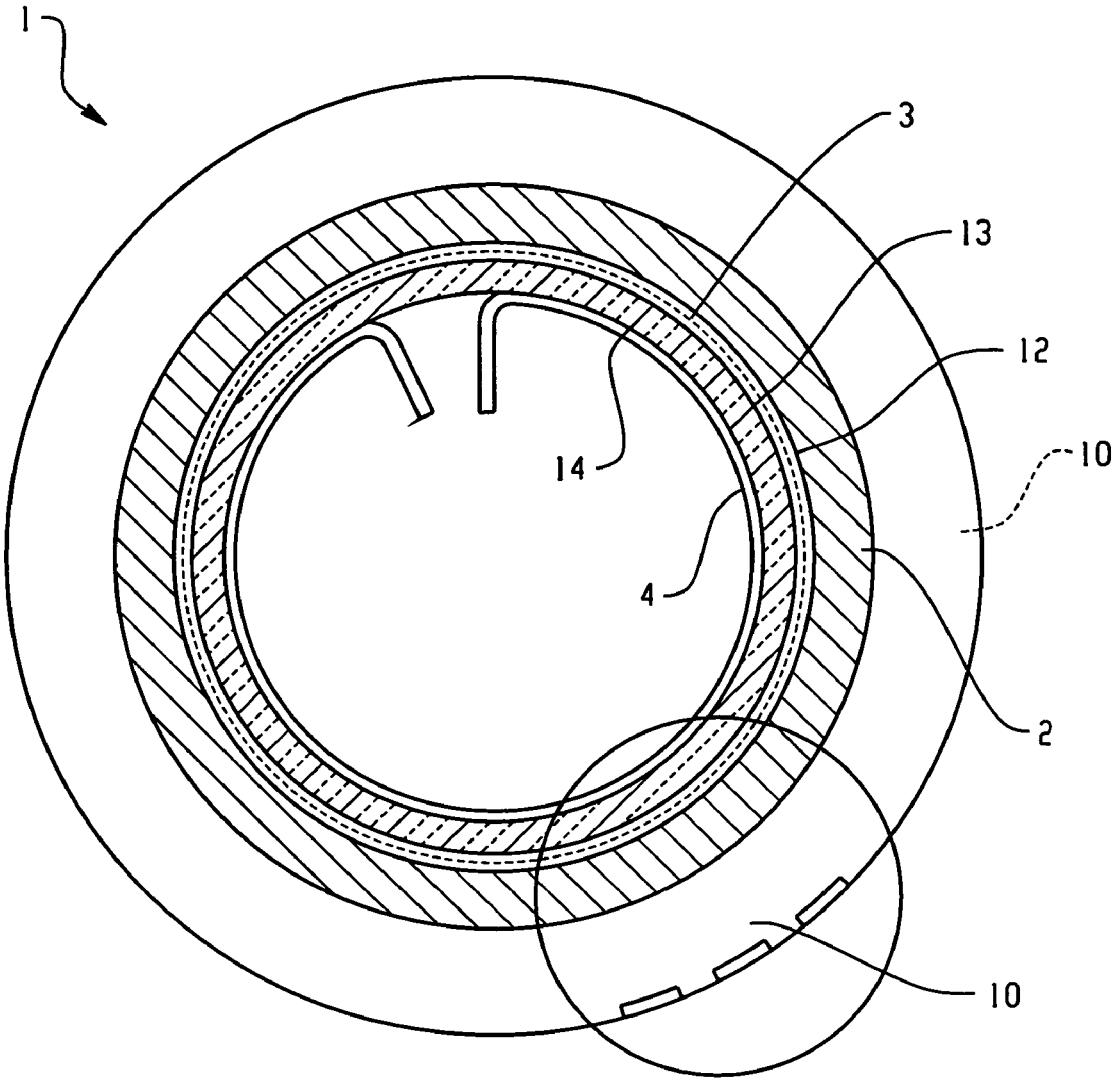

The heating foil is preferably covered at both sides by thin mica like layer 12, 13 (FIG. 2). Towards the cylinder inner side the heating foil 3 is additionally covered by an insulating mat 14 (FIG. 2) which comes to lie between the heating foil 3 and the clamps 4 (heat insulation towards the inside).

When the hub 6 is removed, the heating foil 3 and the clamps 4 can be inserted from the side into the cylinder.

The invention claimed is:

1. Hot stamping cylinder, with a heating system located in a cylinder hollow space, the heating system comprising a heating foil arranged at an inner wall of the cylinder, the heating foil being foreseen as a heater and being designed in such a manner, that heating output of the heater in the area of cylinder ends is higher than in the area between the same.

2. Hot stamping cylinder according to claim 1, characterized in that the heating foil consists of a metal foil provided with a plurality of recesses.

3. Hot stamping cylinder according to claim 2, the recesses being stamped out areas.

4. Hot stamping cylinder according to claim 1, characterized in that the heating foil is covered at both sides by a mica-like material.

5. Hot stamping cylinder according to claim 4 characterized in that the heating foil is covered against the cylinder inner wall by a heat insulation mat.

6. Hot stamping cylinder according to claim 5, the heat isolation mat being a mineral wool felting.

7. Hot stamping cylinder according to claim 1, characterized in that the heating foil is set against the inner wall of the cylinder by clamping means located removable in the cylinder hollow space.

8. Hot stamping cylinder according to claim 7, the clamping means being resilient expansion clamps.

9. Hot stamping cylinder according to claim 1, characterized in that a temperature sensor is foreseen for the controlling of the surface temperature of the cylinder.

10. Hot stamping cylinder according to claim 9, characterized in that the temperature sensor is integrated in the heating foil.

11. Hot stamping cylinder according to claim 9, characterized in that the temperature sensor is arranged in a cylinder jacket or in the cylinder hollow space.

12. Hot stamping cylinder according to claim 1, characterized in that the energy supply and a temperature controlling by a temperature sensor proceed through collector rings at the cylinder.

13. Hot stamping cylinder according to claim 1, characterized in that the cylinder is a thin walled cylinder of metal.

14. Hot stamping cylinder according to claim 13, wherein the cylinder is of aluminum.

15. Hot stamping cylinder according to claim 1, characterized in for an accelerated cooling down of the cylinder means for the supply of cooling air are foreseen.

16. Hot stamping cylinder according to claim 15, wherein the means for the supply of cooling air is a cooling air ventilator.

17. Hot stamping cylinder according to claim 1, the heating foil being so dense that a homogenous heat distribution over the entire width of the working area is ensured.

* * * * *

UNITED STATES PATENT AND TRADEMARK OFFICE

CERTIFICATE OF CORRECTION

PATENT NO. : 7,063,011 B2
APPLICATION NO. : 10/489494
DATED : June 20, 2006
INVENTOR(S) : Robert Nikolaus Roos It is certified that error appears in the above-identified patent and that said Letters Patent is hereby corrected as shown below:

In the Specifications:

Column 1, line 34: After the word "present", please insert the word --invention--;

Column 2, line 29: Please delete the letter "I" and insert in bold the number --1--;

Column 4, line 2: Please delete the word "the" and replace it with --a--;

Column 4, line 18: Please delete the words "for the" and replace it with the word --of--.

Signed and Sealed this

Fifth Day of June, 2007

JON W. DUDAS
*Director of the United States Patent and Trademark Office*